United States Patent [19]

Aunis

[11] 4,211,353

[45] Jul. 8, 1980

[54] SAFETY DEVICE FOR FASTENER DRIVING APPARATUS

[75] Inventor: Jean-Marie Aunis, Bourg-Achard, France

[73] Assignee: Regie Nationale des Usines Renault, Boulogne-Billancourt, France

[21] Appl. No.: 20,736

[22] Filed: Mar. 15, 1979

[30] Foreign Application Priority Data

Mar. 20, 1978 [FR] France ..... 78 07936

[51] Int. Cl.[3] ..... B25C 7/00

[52] U.S. Cl. ..... 227/156; 173/13; 227/8

[58] Field of Search ..... 173/13–17; 227/8, 156

[56] References Cited

U.S. PATENT DOCUMENTS

| | | | |
|---|---|---|---|
| 3,762,620 | 10/1973 | Geist | 227/8 |
| 3,858,781 | 1/1975 | Obergfell et al. | 227/8 |
| 3,942,700 | 3/1976 | Maier | 227/8 |
| 4,040,554 | 8/1977 | Haytayan | 227/8 |

*Primary Examiner*—John McQuade

*Attorney, Agent, or Firm*—Fleit & Jacobson

[57] ABSTRACT

A safety device for apparatus for driving fasteners, notably pneumatic nailing hammers and stapling guns, comprising feeler means substantially circumscribing the passage through which the fasteners are to be ejected. The feeler means are connected to the member controlling the release of the apparatus in such a manner that this release cannot take place unless the feeler means are pressed against a surface to be assembled. The feeler means consist of a plurality of independent feeler points which must be recessed simultaneously, otherwise the apparatus cannot be released. Only one of these feeler points is connected to the trigger of the apparatus and its retraction is normally prevented by positive locking means that cannot be released unless the other feeler points are depressed simultaneously against the force of resilient means urging them to their projecting position.

6 Claims, 5 Drawing Figures

SAFETY DEVICE FOR FASTENER DRIVING APPARATUS

The invention relates to apparatus for driving fasteners, especially for pneumatic nailing hammers and stapling guns, and has specific reference to a safety device for apparatus of this character.

Pneumatic nailing hammers and stapling guns comprise as a rule a safety device consisting of a feeler disposed under the base of the nose thereof and permitting the release of the apparatus only when the feeler contacts the surface of an element or member to be assembled.

Some known types of nailing hammers are also provided with double safety means preventing any "volley" operation thereof. In this case the operator is compelled, when passing from one nailing spot to another, to move the nailing hammer away from the part to be assembled, so as to free the feeler, and then restore its contact with the part, so that he can see the spot where the next nail is about to be driven into the part.

The feeler mainly consists of a ring surrounding the passage through which the fasteners to be positioned are ejected, this ring being coupled through suitable linkage means to the trigger of the apparatus, so that it cannot be actuated by the operator until this ring is depressed and sunk by bearing against the element or part to be assembled.

The purpose of these safety devices is to eliminate any risks of causing corporal injuries as a consequence of the untimely projection of nails or staples in the neighborhood of the working station in case of faulty actuation of the trigger of an apparatus not in direct contact with a surface to be assembled.

However, these known devices are objectionable in that they permit the release of the apparatus even when only one portion of the feeler thereof is caused to bear against a surface. Thus, in the course of assembling operations requiring the use of fasteners located very close to the edge of elements to be assembled, the mutual engagement between a small portion of the feeler and the edge of one of the surfaces of these elements is mot likely to cause the fastener to be ejected outside the element and projected into the surrounding room, with all the dangers thus implied. Likewise, the operator may also hurt himself very seriously by simply depressing the trigger by accident while he just caused only one portion of the feeler to bear against one portion of his body.

The safety device for fastener driving apparatus, notably for pneumatic nailing hammers and stapling guns, according to the present invention, is directed to avoid the above-described inconveniences of prior art devices of this character. In conformity with the present state of the art, it comprises feeler means substantially circumscribing the passage through which the fasteners are to be ejected, this feeler means being so connected to the means controlling the apparatus proper that the latter is released only when the feeler means bears with a certain pressure against a surface to be assembled.

However, the device of this invention departs from the prior art arrangement in that the feeler means consists of a plurality of independent feeler points associated with check means such that the apparatus cannot be released unless all the feeler points are depressed simultaneously. It also departs from the prior art by the fact that only one of the feeler points is connected to the member controlling the release of the apparatus, but this one feeler point is positively prevented from sinking into the device by lock means the release of which is subordinated to the simultaneous depression of the other feeler points constantly urged when inoperative by resilient means to their outermost position of erection.

According to a preferred form of embodiment of the invention, three substantially vertical feeler points are provided; these points are disposed at the vertices of an equilateral triangle of which the point of convergence of the bisectrices merges substantially with the axis of the fastener ejection passage.

Moreover, the lock means consists of a set of horizontal pivot levers constantly urged by resilient means to a position in which they are caused to lock an upper, stop-forming edge of the feeler point connected to the member controlling the release of the apparatus, and each pivot lever is adapted to cooperate with the upper end, respectively, of each feeler point not connected to the control member of the apparatus, so that it is only when all the feeler points are depressed, sunk or retracted into the body of the device that the one feeler point connected to the control member of the apparatus can be depressed or driven into said body by pivoting all of said pivot levers. In other words, the pivoting levers, of which the means for resiliently returning same to the locking position consists of a helical spring attached by its ends to each pivoting lever respectively, are oriented towards the longitudinal axis of the device and constitute jointly a locking stop for the feeler point connected to the control member of the apparatus through their lower ends opposite their pivoting axis, this axis being close to the area where the levers cooperate through complementary cam faces with the upper end of each feeler point not connected to the control member of the apparatus.

The feeler point connected to the control member of the apparatus is slightly shorter than the other feeler points, so that these other feeler points will engage first the surface to be assembled and thus through their preliminary sinking perform an efficient release of said feeler point connected to the control member of the apparatus.

According to other possible arrangements of the preferred form of embodiment of the invention, the lower endmost edge of the feeler points which engage the surface to be assembled has the shape of a circular arc of relatively short length, and the feeler point connected to the control member of the apparatus is located substantially under the front portion of the safety device.

Finally, the complete mechanism of the safety device according to this invention is incorporated into a compact unit easily adaptable to the base of the nose of the fastener driving apparatus, notably commercial pneumatic nailing hammers and stapling guns, as a substitute for the safety devices mentioned in the above preamble. Thus, a maximal safety both for the operator and his surroundings is obtained by using simple, economical means.

A clearer understanding of this invention will be facilitated by the following description of a preferred form of embodiment of the safety device of this invention for fastener driving apparatus, given with reference to the accompanying drawings.

DESCRIPTION OF THE PREFERRED EMBODIMENT

Figure 1:
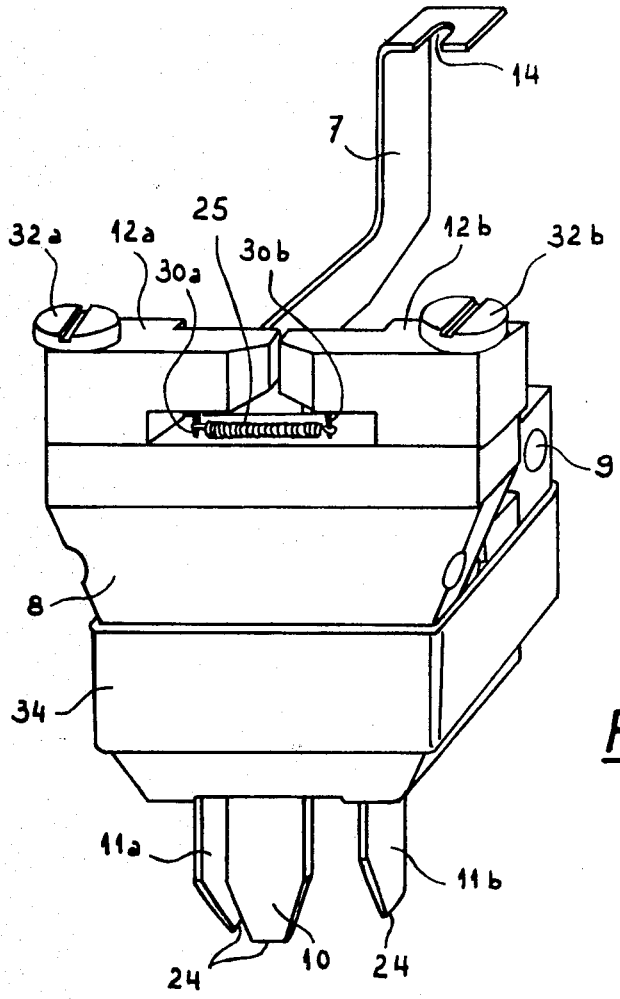
FIG. 1 is a perspective view showing a safety device for fastener driving apparatus, as seen from the front.
Figure 5:
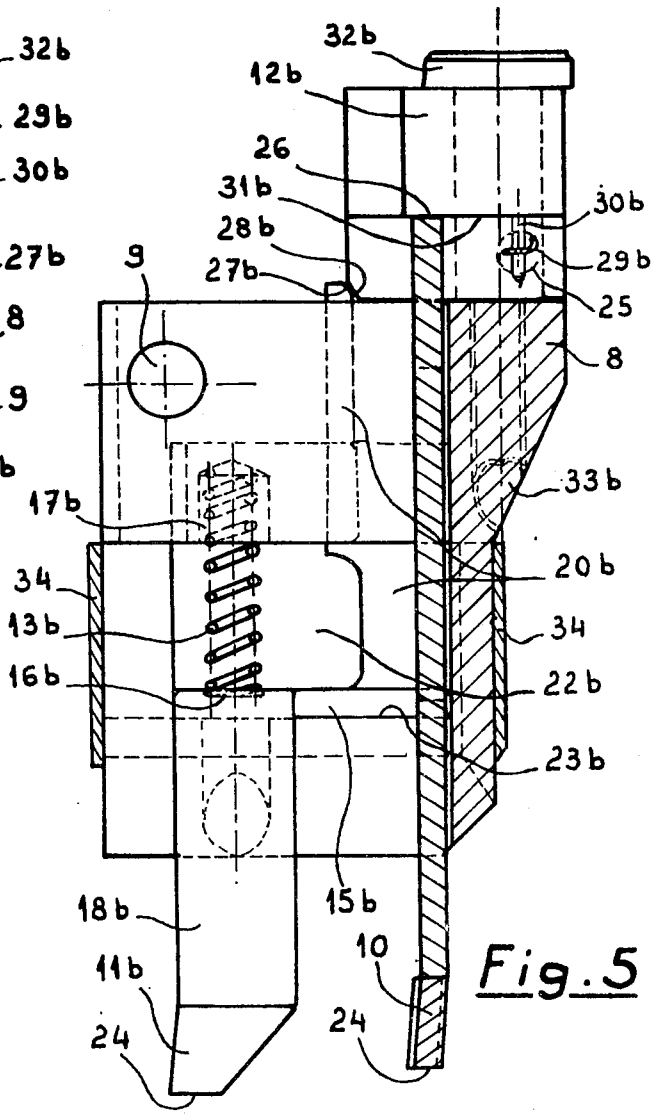
FIG. 5 is a section taken along the line V—V of FIG. 4, showing the safety device of FIG. 1.
Figure 4:
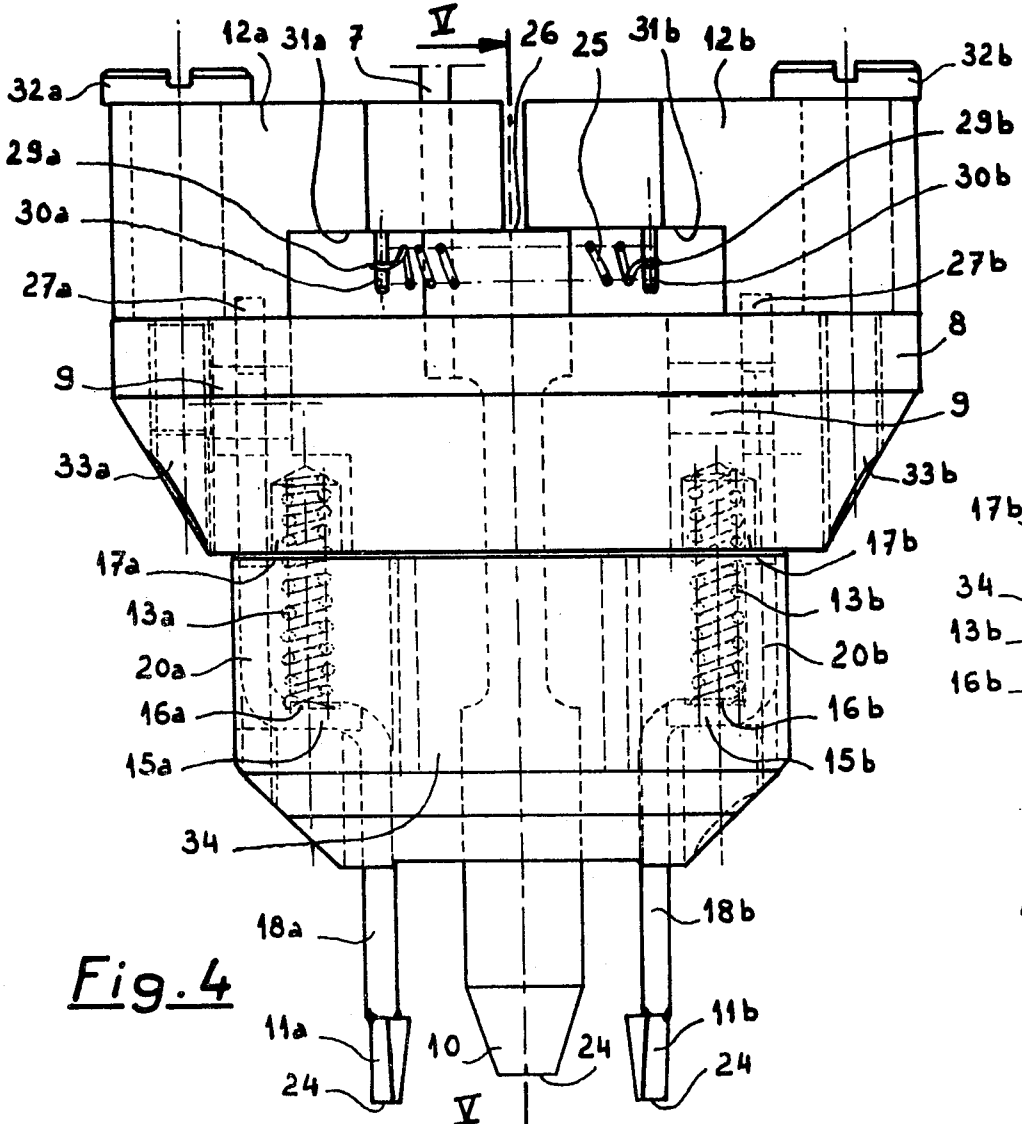
FIG. 4 is a front elevational view of the safety device of FIG. 1.

In the following disclosure it is understood that terms such as "vertical", "horizontal", "upward", etc., are to be taken in conjunction with the safety device as illustrated in FIGS. 1, 4 and 5 of the drawings.

Figure 2:
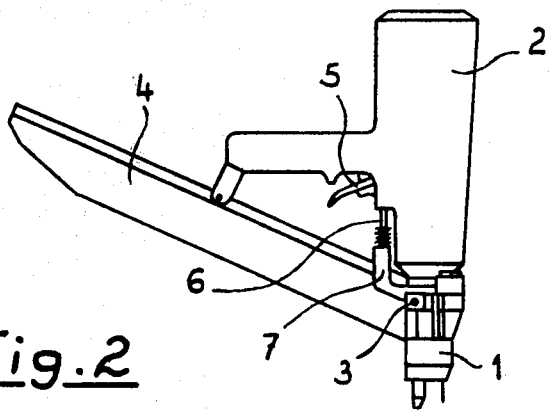
FIG. 2 is a side elevational view showing on a reduced scale the safety device of FIG. 1 associated with a pneumatic nailing hammer.

In the example illustrated in FIG. 2, the safety device 1 according to this invention is associated with a pneumatic nailing hammer 2 and secured thereto by means of screws 3 also assisting in securing the nail feed magazine 4 to the base of the nose of the hammer 2, and its mechanism is connected to the member or trigger 5 controlling the release of the pneumatic nail hammer 2 through a linkage comprising essentially members 6, 7 similar to those currently used in the prior art safety devices of this type.

As clearly apparent from the other Figures of the drawings, this safety device comprises essentially on the one hand a body 8 supporting the mechanism and provided with holes 9 for securing the device to the nose of the pneumatic nail hammer 2 by means of said screws 3, and on the other hand feeler means 10, 11*a*, 11*b* located at the base thereof so as to circumscribe essentially the passage through which the nails are ejected during the operation of the apparatus, this device being connected, as mentioned hereinafter, via a cranked arm 7 and a rod 6, to the trigger 5 controlling the pneumatic nail hammer 2, so that the latter is released only when all of said feeler means 10, 11*a*, 11*b* are pressed jointly against the surface of the part to be assembled.

According to a specific feature characterizing this invention, the feeler means comprise a set of independent feeler points 10, 11*a*, and 11*b* so arranged that the pneumatic nail hammer 2 cannot operate unless they are caused to recess simultaneously into the body 8. However, only one feeler point 10 is connected through said linkage 6, 7 to the control member 5 of the nailer hammer 2, and the sinking of this one feeler point 10 is normally prevented by positive lock means 12*a*, 12*b* the retraction of which is subordinated to the simultaneous retraction of the other feeler points 11*a*, 11*b* urged when inoperative to their outermost position by resilient means 13*a*, 13*b*.

In the exemplary form of embodiment illustrated the feeler points 10, 11*a* and 11*b* are disposed substantially vertically and their number is preferably three; they are disposed in this case at the vertices of an equilateral triangle of which the point of convergence of the bisectrices merges substantially with the axis of the passage through which the nails are to be ejected.

Figure 3:
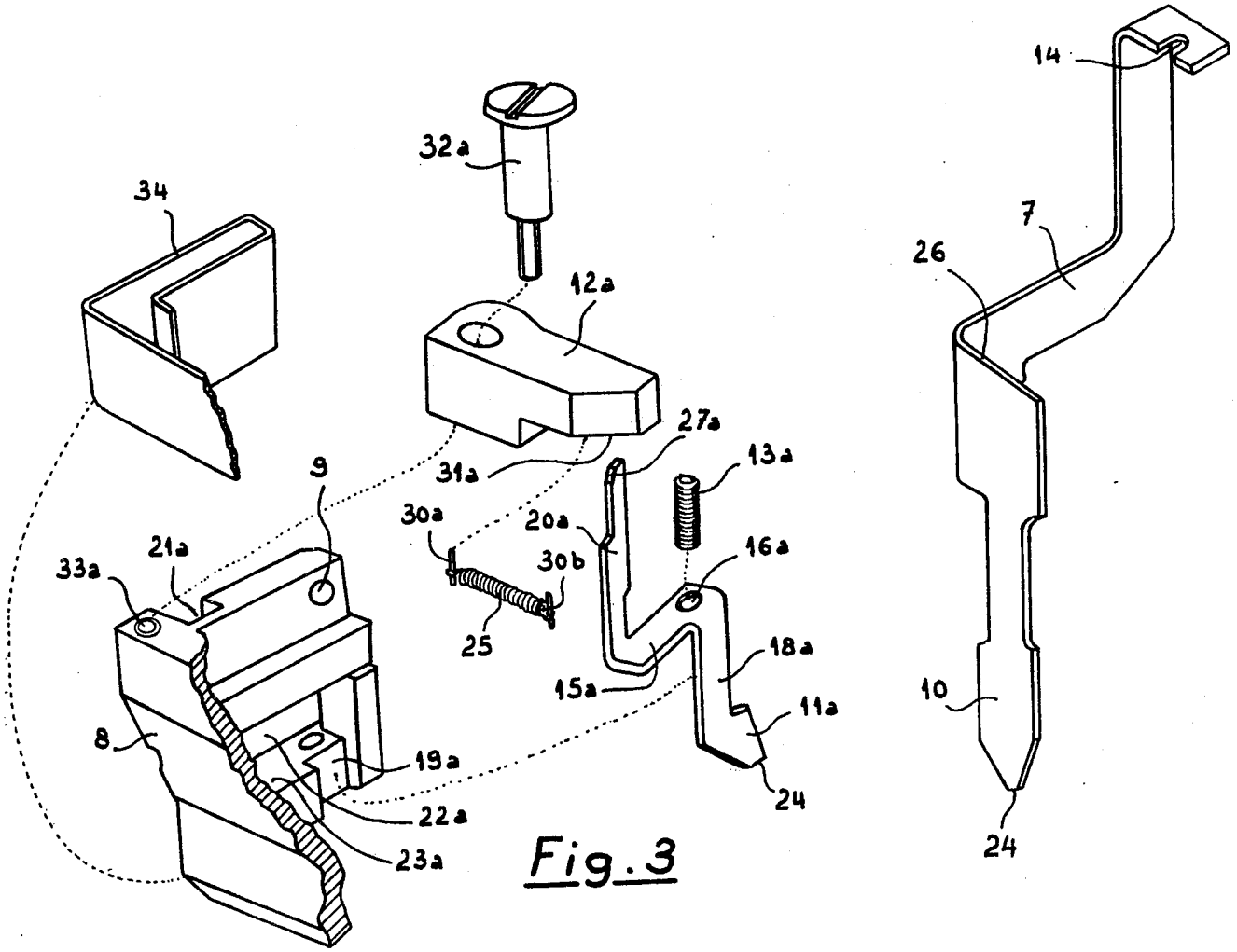
FIG. 3 is a fragmentary exploded view of the safety device of FIG. 1, in which the various component elements of the mechanism are shown by reason of one piece of each to simplify the reading of the drawing.

As shown more in detail in FIGS. 3, 4 and 5, the feeler points 10, 11*a* and 11*b* consist of pressed steel elements. The cranked arm 7 connecting the device to the trigger 5 of the pneumatic nailing hammer advantageously consists of an upper extension of feeler point 10 and has formed at its upper end, bent at right angles as shown, a notch 14 engageable by the connecting rod 6, and the other feeler points 11*a* and 11*b* comprise each an intermediate flat portion 15*a*, 15*b* having formed on its top surface a shallow flat-bottomed blind hole 16*a*, 16*b* for receiving the lower end of the corresponding resilient means 13*a*, 13*b* constantly urging said other feeler points 11*a*, 11*b* to their outermost position, said resilient means consisting each of a coil compression spring having its upper end engaged in a corresponding blind hole 17*a*, 17*b* formed in the body 8. Except for its lower end, constituting the feeling portion of the point, and its connecting cranked arm 7, the feeler point 10 moves completely inside the body 8, whereas the other feeler points 11*a*, 11*b* are guided during their vertical movements by means of their lower portion 18*a*, 18*b* slidably fitted in a guide groove 19*a*, 19*b* formed internally of the body 8, and by means of their upper portion 20*a*, 20*b* slidably engaging a guide groove 21*a*, 21*b* formed externally of the body 8, the movements of said feeler points 11*a*, 11*b* through the body 8 at the level of their horizontal portions 15*a*, 15*b* being permitted by the provision of a relatively large aperture 22*a*, 22*b* formed in said body 8, the lower face 23*a*, 23*b* of said apertures 22*a*, 22*b* also acting as a stop means engageable by said horizontal portions 15*a*, 15*b* in the outermost position of said feeler points 11*a* and 11*b*.

According to a preferred version of this form of embodiment, the edge 24 at the lower end of the feeler points 11, 11*a* and 11*b* which contacts first the surface to be assembled has a circular arc configuration of relatively short length, and the feeler point 10 connected to the trigger 5 controlling the pneumatic nailing hammer 2 lies substantially under the front portion of the safety device.

The locking means contemplated according to the instant invention comprise essentially a pair of symmetrically opposed pivoting horizontal levers 12*a*, 12*b* urged jointly by resilient means 25 to an aligned position in which they engage, and prevent the upward movement of, a horizontal edge 26 formed at the upper end of the feeler point 10 connected to the trigger 5 controlling the pneumatic nailing hammer 2, and each lever 12*a*, 12*b* is adapted to cooperate via a set of cam faces 27*a*, 27*b*, 28*a*, 28*b* with the upper end of each feeler point 11*a*, 11*b* not connected to the trigger 5, so that only the upward movement (as seen in the drawings) of both feeler points 11*a*, 11*b* will release the feeler point 10 and permit the upward movement of this feeler point 10 connected to the trigger 5 of the apparatus 2, this upward movement of feeler point 10 being permitted by the pivotal movement of the pair of pivot levers 12*a*, 12*b* towards the front of the safety device. More particularly, the pivoting levers 12*a*, 12*b* are constantly urged by a horizontal traction coil spring 25 to their locking position; this spring 25 is attached to the two pivot levers 12*a*, 12*b* by having its ends 29*a*, 29*b* fitted in a groove formed in short studs 30*a*, 30*b*, each force-fitted vertically into the bottom surface 31*a*, 31*b* of the relevant pivoting lever 12*a*, 12*b*, which are thus constantly urged towards the longitudinal axis V—V of the safety device and form together a stop member preventing jointly with their bottom faces 31*a*, 31*b* the upward movement of the feeler point 10 connected to the trigger 5 of nailing hammer 2. The levers 12*a*, 12*b* are each pivotally mounted by means of a shouldered screw 32*a*, 32*b* engaging with its screw-threaded end portion a tapped hole 33*a*, 33*b* formed in the top front portion of the body 8; the axis of said pivot screw is located in the vicinity of the area where the cam faces 27*a*, 27*b*, 28*a*, 28*b* cooperate with the upper end of each feeler point 11*a*, 11*b* not connected to the trigger 5 controlling the release of the pneumatic nailing hammer 2, so that the upper edge 26 of the other feeler point 10 can be released without requiring an excessive vertical movement of these feeler points 11*a*, 11*b*.

As clearly shown in FIGS. 4 and 5, the feeler point 10 connected to the trigger 5 controlling the release of the pneumatic nailing hammer 2 is slightly shorter than the other feeler points 11*a* and 11*b*, so that the latter, by engaging first the surface of the part to be assembled, will be depressed preliminarily so as to efficiently release said feeler point 10 connected to the trigger 5.

Finally, a case 34 of pressed sheet metal is fitted on the body 8 at the lever of apertures 22*a* and 22*b* so as to cover the latter externally and internally, as shown more particularly in FIG. 3, and to protect the intermediate portion where the feeler points 11*a*, 11*b* and their resilient return means 13*a*, 13*b* are located. Due to the provision of this case 34, the apertures 22*a* 22*b* may advantageously be packed with grease for efficiently and lastingly lubricating the areas of frictional contact between the feeler points 11*a*, 11*b* and the grooves formed in the body 8.

From the foregoing, it is clear that the safety device according to this invention constitutes a compact assembly of reduced over-all dimensions, which is simple and economical to manufacture, and is easily adaptable to the base of the nose of the apparatus for driving fasteners, notably in the case of commercial pneumatic nailing hammers and stapling guns, while providing the best possible degree of safety for the operator and his surroundings.

I claim:

1. A safety device for use with an apparatus for driving fasteners, such as pneumatic nailing hammers and stapling guns, the apparatus including an ejection passage for ejecting fasteners, and control means including a trigger for controlling ejection of fasteners, said device comprising:

a body connectable to said apparatus, said body including an opening alignable with the ejection passage of the apparatus; and feeler means operatively associated with said body and substantially circumscribing the ejection passage for preventing actuation of the apparatus by the control means, said feeler means being connected to the control means of the apparatus so that the trigger is released only when said feeler means engages with pressure a surface receiving a fastener, said feeler means including:

a plurality of independent feeler points interconnected in such manner that actuation of the apparatus can occur only upon simultaneous depression of all of said feeler points, one of said feeler points being connected to the trigger in such manner that the trigger can be actuated only upon depression of the one feeler point;

locking means for preventing depression of the one feeler point, the locking means being releasable upon simultaneous depression of the remaining of said feeler points; and resilient means for urging said feeler points to outermost projecting positions.

2. A safety device as claimed in claim 1, which comprises three feeler points extending substantially vertically and disposed at the vertices of an equilateral triangle of which the points of convergence of the bisectrices merge substantially with the axis of the passage through which the fasteners are to be ejected.

3. A safety device as claimed in claim 1, wherein said locking means comprise a set of pivoting horizontal levers urged together by resilient return means to a locking position in which they engage and stop a top edge of the one feeler point connected to said trigger, each pivoting lever cooperating with the top end of each feeler point not connected to said trigger, whereby only the retraction of all the feeler points enables the feeler point connected to said trigger to recede in turn into the device by causing the retraction of said pivoting levers.

4. A safety device as claimed in claim 3, wherein said resilient return means comprises a helical traction coil spring urging said pivoting levers to their locking position, the ends of said spring being attached to each lever, respectively, said pivoting levers being oriented towards the longitudinal axis of the ejection passage of the device and acting jointly as a stop for preventing the inward movement of said one feeler point connected to said trigger, the arrangement being such that said pivoting levers when in their locking positions engage jointly with their bottom surfaces said one feeler point connected to said trigger, such engagement occurring at locations relatively close to each other.

5. A safety device as claimed in claim 1, wherein said feeler point connected to said trigger is slightly shorter than the other feeler points, whereby said other feeler points will normally engage first the surface receiving the fastener, thus causing through their preliminary recession the release of said feeler point connected to said trigger.

6. A safety device as claimed in claim 1, wherein the lower end edges of said feeler points which are to engage the surface to be assembled have the shape of a circular arc of relatively short length.

* * * * *